United States Patent [19]

Williams

[11] 4,133,568

[45] Jan. 9, 1979

[54] LIFT DEVICE

[75] Inventor: David W. Williams, Toledo, Ohio

[73] Assignee: Owens-Illinois, Inc., Toledo, Ohio

[21] Appl. No.: 791,807

[22] Filed: Apr. 28, 1977

[51] Int. Cl.[2] ..... B66C 1/18

[52] U.S. Cl. ..... 294/74; 294/31.2

[58] Field of Search ..... 294/31.2, 67 BA, 74–77; 214/DIG. 4; 224/45 N, 45 Q, 49–58

[56] References Cited

U.S. PATENT DOCUMENTS

| | | | |
|---|---|---|---|
| 873,044 | 12/1907 | Hanson | 294/74 |
| 1,332,234 | 3/1920 | Raidt | 294/74 |
| 2,076,758 | 4/1937 | Whiting | 294/74 |
| 2,508,795 | 5/1950 | Nielsen | 224/53 |
| 2,831,720 | 4/1958 | Renfroe | 294/31.2 |
| 2,849,252 | 8/1958 | McLean | 294/31.2 |
| 3,744,836 | 7/1973 | Goettl | 294/67 BA |

*Primary Examiner*—Johnny D. Cherry

*Attorney, Agent, or Firm*—David R. Birchall; Myron E. Click; David H. Wilson

[57] ABSTRACT

A method and apparatus for moving rolls of plastic material from one location to another. The apparatus consists of a belt that is tightened around the periphery of the roll. Strategically positioned lift attachments are positioned on the belt so that various diameter rolls can be moved by the same belt.

3 Claims, 2 Drawing Figures

LIFT DEVICE

BACKGROUND OF THE INVENTION

Figure 1:
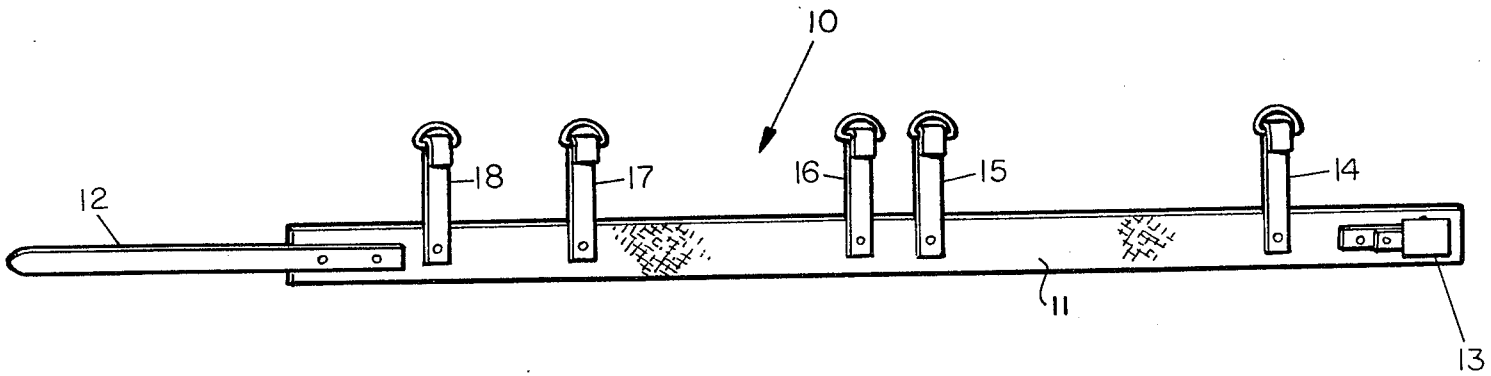

For quite some time it has been common to move rolls of coiled sheet material from place to place by inserting a lift or clamping device in the central core upon which the sheet material is coiled. Generally the coiled sheet material, such as for example sheet steel and newspaper stock, is transported and stockpiled by placing the axis of the roll in a horizontal direction. Thus lift trucks, etc. can approach a roll of sheet material laying on the floor and by inserting a lift mechanism into the roll core, the roll can be moved. Various pneumatic and mechanical expansion devices have been made to securely hold the lift device within the core. The rolls of sheet material were moved from place to place with the axis of the roll always remaining in a horizontal attitude. This method of transporting rolls of sheet material worked well because generally the diameter of the roll was roughly equal to the overall length of the roll. Then, too, in almost all instances the sheet stock was dispensed from the roll with the axis of the roll remaining horizontal. There was no real advantage to be gained by placing the roll in a position other than with its axis horizontal.

SUMMARY OF THE PRESENT INVENTION

With the advent of very lightweight material such as foam plastic sheet stock, various articles have been manufactured. One such article is the foam drinking cup which is quite similar to the ordinary paper vending or drinking cup. Foam cups are manufactured from oriented plastic sheet stock which is controllably deformed by heat to form cups to their final configuration. With modern fabrication techniques it is possible to preprint foam sheet material by high speed printing presses. The preprinted sheet stock is then slit into narrow widths and placed in rolls. Because of the low density of the foam material, large diameter rolls can be made before the mass of the foam becomes appreciable. The individual rolls, while only two or three inches in width, can approach five or six feet in diameter. Such rolls of plastic material are massive in size, however, the overall weight can be as low as 100 pounds.

The rolls are created with their axis in a horizontal direction and ultimately the rolls are used with the roll axis oriented in a horizontal attitude, however, it becomes difficult to move the rolls from place to place while maintaining their axis horizontal. The rolls of plastic foam sheet lack the stability of the previously discussed rolls of steel where the sheet width is roughly equal to the roll diameter. The rolls of foam sheet accommodate themselves quite well to a position where the roll axis is vertically aligned. When the rolls are placed flat upon one another there is less shifting and damage to the rolls.

Conventional roll moving equipment was tried without much success. A chucking mechanism was inserted into the roll spool and upon lifting, the rolls would telescope and come apart. The very delicate nature of the narrow foam band precluded rewinding the roll, thus it became scrap. When the rolls were positioned one upon another it was difficult to use a scoop-like lift since damage would occur to the foam material.

The present invention removed the disadvantages encountered in the prior roll lifting and moving equipment. The present invention permits a strap or band to be placed around the outside periphery of the roll. A lifting force is then applied to the band without the prior art disadvantages which caused the roll to come apart. By placing the pickup load around the exterior of the roll there was sufficient frictional force generated between the adjacent layers of the foam sheet material to support the entire mass of the roll. In contrast, when the rolls were previously supported by a centrally positioned spool pickup, the diameter of the roll layers immediately adjacent to the spool was not great enough to provide a sufficient frictional area that would support the entire weight of the roll, consequently, each layer would shift and the roll would telescope.

Accordingly, it is the primary object of the invention to provide an apparatus for attachment to a roll of material so that it may be transported from one place to another without damage occurring to the roll.

Another object of the invention is to provide an apparatus that will not damage frangible material when the apparatus is applied to said roll.

An additional object of this invention is to provide a lifting apparatus that can accommodate rolls having different diameters and weights.

Another object of the present invention is to set forth a method of storing and moving rolls of material where the ratio of roll width to roll diameter is quite high.

Figure 2:
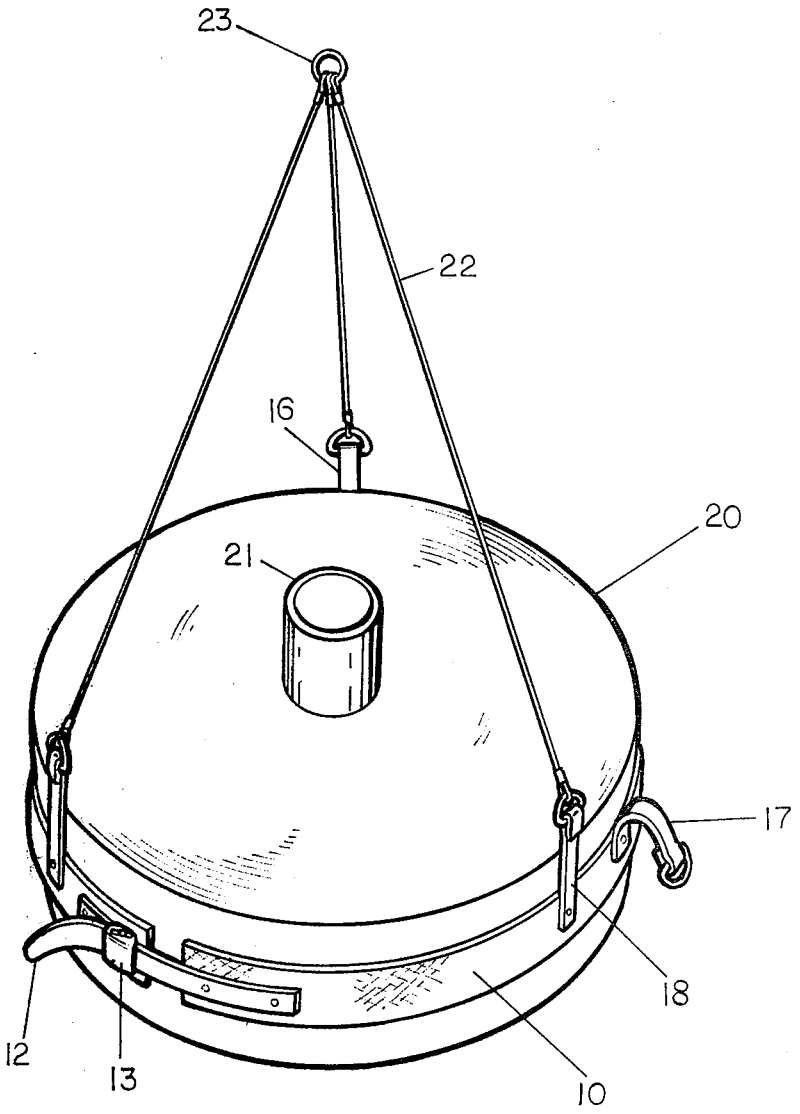

Other objects and advantages of the invention will be apparent from the following detailed description of the presently preferred embodiment which description should be considered in conjunction with accompanying drawings in which:

FIG. 1 is a perspective view of the lift apparatus of the present invention; and FIG. 2 is a perspective view of the apparatus as it is actually employed in lifting a roll of material.

The present invention is directed to a method and apparatus for lifting rolls of frangible material such as foam plastic sheet stock where the width of the roll is extremely narrow and the diameter of the roll is great.

The apparatus is shown generally at 10 in FIG. 1. A main member 11 is elongate in form and is of sufficient length to almost completely circumscribe a roll of plastic sheet material having a diameter in the range of six feet. The main member 11 has a secondary member 12 attached to one end. The secondary member 12 is preferably narrower in width than the width of main member 11. The other end of main member 11 contains a tightening or holding buckle 13 which is adapted to accommodate the free end of secondary member 12. It is to be understood that it is within my invention to have secondary member 12 be but an extension and integral part of main member 11 and also have an identical width. In this particular embodiment, the buckle 13 would by necessity have to be wider than the width of main member so that the free end 12 could be introduced into and grasped thereby.

A series of lift straps 14–18 are strategically positioned along the linear extent of main member 11. The lift straps 14–18 are arranged generally perpendicular to the axial direction or extent of main member 11. Lift strap 14 is positioned nearest to buckle 13 as shown in FIG. 1. Lift straps 15 and 16 are positioned toward the central portion of the overall apparatus 10. Lift straps 17 and 18 are positioned toward the end of apparatus 10 most remote from buckle 13. It can be observed that lift straps 15 and 16 are spaced somewhat apart from one another and that lift straps 17 and 18 are also spaced from one another but at a greater distance than the distance between lift straps 15 and 16. The purpose of the spacing of the lift straps will now be explained.

The rolls of narrow foam sheet stock that are to be transported by the overall apparatus 10 vary in diameter depending upon the thickness and the particular production run involved. Then too, partially used rolls are transported from one position to another. The present invention provides for the variation in roll diameter by means of the positioning of lift straps 14–18. Lift strap 14 is positioned nearest buckle 13 and is always utilized as a lift point regardless of the size of the roll that is to be transported from one location to another. If the roll is small to medium in diameter, then the second lift strap to be employed is lift strap 15. Lift strap 17 is also used when the roll diameter dictates the use of lift strap 15. The three pickup points defined by lift straps 14, 15, and 17 will approximate 120 degrees spacing from one another as overall apparatus 10 is applied to the periphery of a roll of foam sheet stock material. Thus the weight of the roll will be fairly equally distributed over the three pickup locations.

When a larger roll is to be lifted and transported by the overall apparatus 10, lift strap 14 is once again utilized as the first pickup point. The remaining pickup points are provided by lift straps 16 and 18, thus the spacing between each of the pickup points can be maintained at approximately 120 degrees on the larger roll.

FIG. 2 is a perspective view showing the overall apparatus 10 as it is utilized with a roll of foam plastic sheet material. The roll 20 of sheet material is coiled as tight as practicable, however, by its inherent nature the adjacent layers of the coil have a tendency to slip with respect to each other. The coil 20 is wound on a centrally positioned hollow spool or hub 21 that is used for mounting the roll 20 in a vertical direction with the roll axis horizontally aligned. Prior to Applicant's invention, centrally positioned hub 21 was utilized with an internal chucking arrangement for lifting and transporting rolls 20.

The overall apparatus 10 is placed around the periphery of roll 20 and the secondary member 12 is inserted through buckle 13. The main member 11 and a portion of secondary member 12 are placed in hoop tension around roll 20 by pulling the free end of member 12 through the locking mechanism of buckle 13. One of the lift cables 22 is coupled to lift strap 14 and the remaining two lift cables 22 are then coupled to lift straps 15, 17 or 16, 18 depending upon the size of roll 20 and how well the roll appears to be balanced as an upward force is applied to hoist ring 23. In FIG. 2, the drawing depicts a large sized roll of foam plastic sheet material, consequently, lift straps 16 and 18 are employed along with lift strap 14. Observe that unused lift strap 15 (not shown) and lift strap 17 bend down out of the way and do not hamper in the transporting of roll 20 from one location to another.

While it has heretofore been pointed out that the preferred embodiment of the invention relates to an overall assembly being manufactured of a fabric material, it is considered to be within the purview of my invention to use a circumscribing band or assembly made of a resilient material such as steel. Also, it is contemplated that the main band or member can be made of metal and the individual lift straps 14–18 can be made from a non-metallic web-like material.

Since the weight of the individual rolls of foam sheet material is relatively light, the overall apparatus 10 and its associated parts need not be massive nor heavy. Consequently, it is anticipated that it is possible to position the overall apparatus around a roll of material and permit it to remain in position not only when the roll is being transported from one location to another by means of an overhead crane or the like, but also during storage. The light weight of the rolls permits manual handling which necessitates lifting the rolls by the placing of hands on the periphery of the roll. The overall apparatus 10 can remain in position during the manual handling to insure that the roll will not telescope. Once the roll has telescoped, it is virtually impossible to rewind it without damaging the foam sheet material.

It is also contemplated that the method of transporting rolls should be part of my invention. As has been commented upon previously, the rolls of foam sheet material are of different sizes and provisions have been provided for assuring that the roll is transported with the load fairly well distributed over a plurality of pickup locations. The placement of the pickup points is important to assure that all the load is not applied at one location, thus causing the roll to telescope. Also, it is important to tighten the overall apparatus 10 around the periphery of the roll so that enough frictional force is generated between the inside of the band or member 10 so that it will not slide off when the roll is supported by a lift device. Then too, it is important that the overall aparatus 10 not be tightened too tight or else the outer layers of the foam material will be coined or mutilated, thus necessitating a discarding of the first few layers of the roll.

The method involves the steps of positioning the band around the periphery of the roll and applying a constrictive force large enough to hold the band firmly in place. Thus the roll can be lifted without telescoping. The roll can then be placed so that its central axis is vertically oriented. Heretofore rolls of sheet material were generally always transported from place to place with the roll axis remaining in a horizontal attitude. Even sheet material such as steel is transported with the roll axis oriented in the horizontal direction. Rolls thus transported by my method can be stored flat until they are ready to be moved to the production line.

It is to be understood that the various details of construction and arrangement of parts may be made without departing from the intent and spirit of the invention.

What is claimed is:

1. A lift device for attachment to a roll of frangible material, said device comprising an elongate flexible band having two ends, a band fastening means attached to one end of said band and a secondary member attached to the other end of said band, said secondary member designed for coacting with and being grasped by said fastening means, a single lift strap attached to said band adjacent to one end thereof, a first pair of spaced apart lift straps positioned adjacent to and attached near the other end of said band, and a second pair of spaced apart lift straps attached to said band and positioned intermediate said single lift strap and said first pair of straps, the spacing between said single lift strap and said second pair of straps and the spacing between said second pair of straps and said first pair of straps exceeding the space between the individual members of said first and second pair of straps.

2. A lift device for attachment to the periphery of a roll of frangible material, said device comprising an elongate flexible band wherein the width greatly exceeds the thickness and the length greatly exceeds the width, said band having first and second ends, a band fastening means attached to the first end of said band, said second end designed for coacting with and being grasped by said fastening means, a single lift strap attached to said band adjacent said first end of said band, a first pair of spaced apart lift straps positioned adjacent to the second end of said band and attached to said band, and a second pair of spaced apart lift straps attached to said band and positioned intermediate said single lift strap and said first pair of straps, the spacing between said second pair of straps being less than the spacing between said first pair of straps.

3. A lift device for attachment to a roll of frangible material, said device comprising an elongate flexible band wherein the width greatly exceeds the thickness and the length greatly exceeds the width, said band having first and second ends, a band fastening means attached to said first band end and a secondary band member attached to the second end of said band, said secondary member designed for coacting with and being grasped by said fastening means, a single lift strap attached to the first end of said band, a first pair of spaced apart lift straps positioned adjacent said second band end, a second pair of spaced apart lift straps attached to said band at locations intermediate said single lift strap and said first pair of lift straps, the spacing between said single lift strap and said second pair of straps and the spacing between said second pair of straps and said first pair of straps exceeding the space between the individual members of said first and second pair of straps, and wherein the spacing between said second pair of straps is less than the spacing between said first pair of straps.

* * * * *